United States Patent [19]

Peck

[11] Patent Number: 5,027,786

[45] Date of Patent: Jul. 2, 1991

[54] BOW STRING RELEASE

[75] Inventor: Paul L. Peck, Fond du Lac, Wis.

[73] Assignee: Archery Designs, Inc., North Fond du Lac, Wis.

[21] Appl. No.: 502,975

[22] Filed: Apr. 2, 1990

[51] Int. Cl.[5] ..... F41B 5/00

[52] U.S. Cl. ..... 124/35.2

[58] Field of Search ..... 124/23.1, 25.6, 35.1, 124/35.2

[56] References Cited

U.S. PATENT DOCUMENTS

| | | | |
|---|---|---|---|
| 4,004,564 | 1/1977 | Castonguay | 124/35.2 |
| 4,009,703 | 3/1977 | Cunningham | 124/35.2 |
| 4,308,851 | 1/1982 | Kaine et al. | 124/35.2 |
| 4,316,443 | 2/1982 | Giacomo | 124/35.2 |
| 4,403,594 | 7/1983 | Todd | 124/35.2 |
| 4,625,705 | 12/1986 | Willits | 124/35.2 |
| 4,691,683 | 9/1987 | Peck | 124/35.2 |

*Primary Examiner*—Peter M. Cuomo
*Assistant Examiner*—John A. Ricci
*Attorney, Agent, or Firm*—Andrus, Sceales, Starke & Sawall

[57] ABSTRACT

A bow string release includes a sear mounted in a body for pivotal movement between a string retaining position and a string release position. A notch is provided in the body for receiving the bow string. A release member is pivotally mounted within the body and engageable with the sear to either prevent or allow pivotal movement of the sear. A trigger extends from the pivoting release member and extends outwardly through an opening in the body. The body surfaces defining the bow string receiving notch are curved convexly to allow limited rotational movement of the bow release while it is maintaining a bow string in the drawn position.

15 Claims, 2 Drawing Sheets

FIG. 5
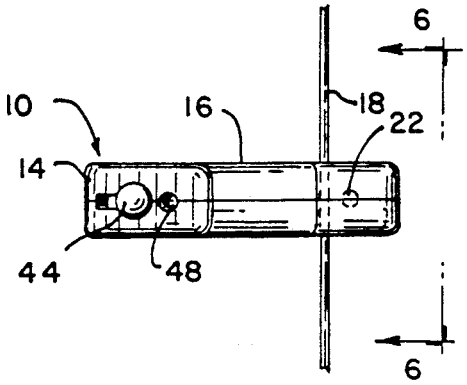
FIG. 7
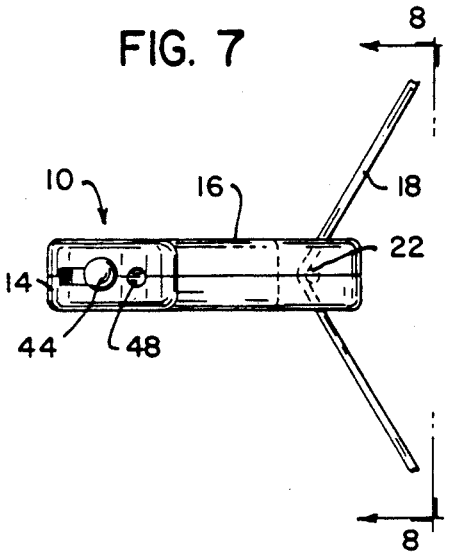
FIG. 6
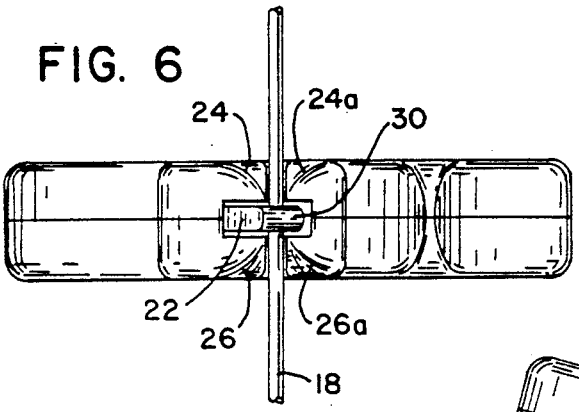
FIG. 8
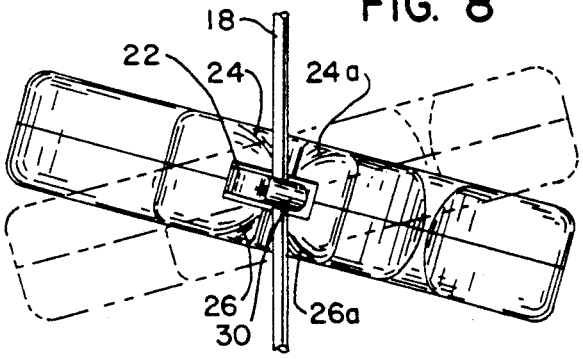
FIG. 9
PRIOR ART
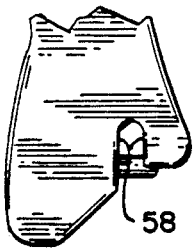
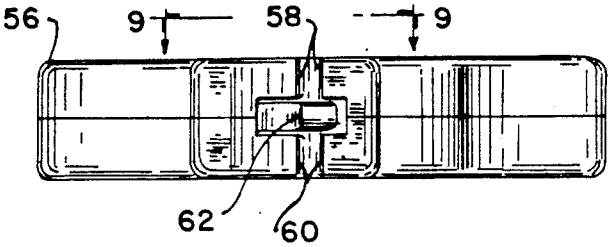
FIG. 10
PRIOR ART

BOW STRING RELEASE

BACKGROUND OF THE INVENTION

The present invention relates to bow string releases and more particularly to releases that allow for rotational movement of the release while it is holding a bow string in the drawn position.

Many archers in both hunting and target shooting prefer to use a bow string release and also prefer that they be able to rotate their hand slightly while the bow string is in the drawn position. Prior art devices have provided this feature by utilizing a two piece release in which the forward string retaining portion of the release is rotatably mounted to a handle and body portion containing the trigger for the release. These rotatable two piece connections are considerably more complex than a single bodied release which adds to the cost of the release and makes the release more complex to manufacture and assemble.

It is an object of the present invention to provide a simple single body release that permits some rotation of the release by the user while the bow string is in its drawn position.

It is a further object of this invention to provide a bow release that has a self-locking sear which facilitates the positioning of the release on the bow string.

It is yet another object of this invention to provide a simple triggering mechanism having independent adjustments for the length of travel and trigger tension.

SUMMARY OF THE INVENTION

A bow string release includes a body having a plurality of surfaces that define a string receiving notch. The surfaces are convexly rounded so that when the bow string has been pulled to a drawn position the release may be rotated a pre-determined distance about a substantially horizontal axis.

In accordance with another aspect of the invention, the bow string release is provided with a sear pivotally mounted in the body and movable between a string retaining position and a string release position. The sear is biased to its release position and provided with a finger that extends downwardly and forwardly into the notch so that a bow string being moved into the notch will engage the finger and move it rearwardly into the notch causing the sear to pivot to the retaining position.

In accordance with yet another aspect of the invention, the release is provided with a release member that is pivotally disposed within the body and movable between a first position in which movement of the sear from the retaining position is prevented and a second position in which movement of the sear is permitted. The release member is biased toward the first position to assist in the self-locking feature of the release.

In accordance with still another aspect of the invention, the release is provided with a trigger that is connected to the release means and extends outwardly from the body through an opening provided in the body. The trigger means is operative to move the release member from the first to the second position.

In accordance with still another aspect of the invention, a pair of independent adjustment means are provided for varying the length of trigger travel needed for release of the sear and for varying the trigger tension.

The present invention thus provides a single bodied release that allows for limited rotation of the release when the bow string is in a drawn position.

The present invention also provides a bow release that is self-locking and utilizes an easily adjustable triggering mechanism.

BRIEF DESCRIPTION OF THE DRAWINGS

The drawings illustrate the best mode presently contemplated of carrying out the invention.

In the drawings:

FIG. 5 is a side view of the release shown in FIG. 1 with the bow string in a restrained but undrawn position;

FIG. 6 is a sectional view along the line 6—6 in FIG. 5;

FIG. 7 is a view similar to that of FIG. 5 with the bow string shown in a drawn position;

FIG. 8 is a sectional view along the line 8—8 of FIG. 7;

FIG. 9 is a sectional view along line 9—9 of FIG. 10; and

FIG. 10 is a front view of a prior art bow release.

DETAILED DESCRIPTION OF THE PREFERRED EMBODIMENT

Figure 1:
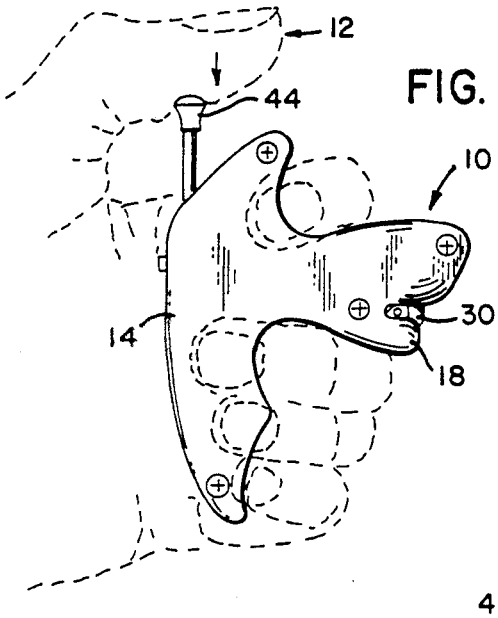
FIG. 1 is a bottom view of a bow release constructed according to the present invention and held in the left hand of an archer with a bow string disposed within the release.
Figure 4:
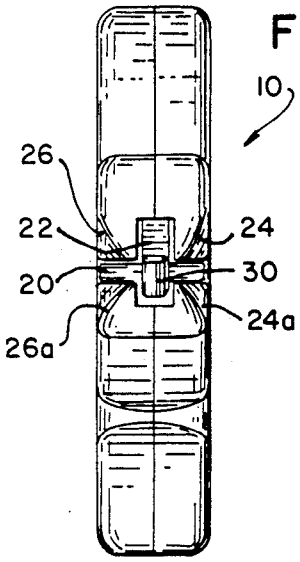
FIG. 4 is a front view of the release shown in FIG. 1.

FIG. 1 illustrates a bottom view of a bow release 10 as it is held in the left hand 12 of an archer. Since this is a bottom view, both handle portion 14 and body 16 lie in a horizontal plane in order to accomodate bow string 18 which lies in a generally vertical plane.

Body 18 includes a plurality of convexly rounded surfaces that define bow string receiving notch 20 that may be closed by a string retaining means in the form of sear 22 that is pivotally disposed within body 16. More specifically, the plurality of convexly curved surfaces includes a pair of surfaces 24 and **24*a* that will be disposed adjacent a portion of the bow string disposed above the sear when the release is pulled to a drawn position. The plurality of surfaces also includes a pair of surfaces 26 and 26*a*** that are disposed adjacent a portion of the bow string located below the sear when the release is pulled to its drawn position. The function of these surfaces will be described in detail below.

Figure 2:
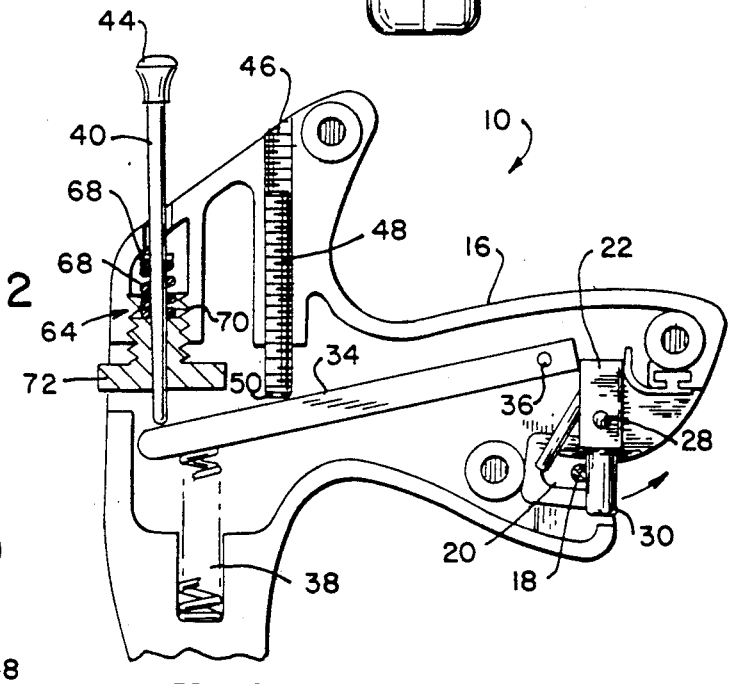
FIG. 2 is a partial cross-sectional view of the release of FIG. 1 in a bow string restraining position.
Figure 3:
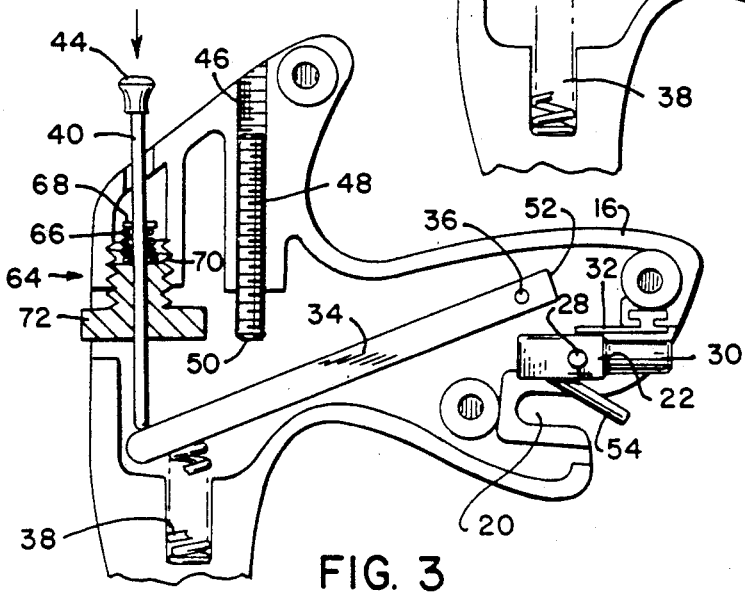
FIG. 3 is a view similar to that of FIG. 2 with the release shown in the string releasing position.

As mentioned above, a sear 22 is pivotally mounted at pivot point 28 within body 16. Sear 22 may be pivoted to a bow string retaining position such as that shown in FIG. 2 in which extension 30 on sear 22 closes notch 20 and retains bow string 18 within the notch. As seen in FIG. 3, sear 22 may be allowed to pivot to a release position in which the bow string is allowed to leave notch 20. A biasing member 32 acts on a surface of sear 22 and urges it to the release position.

Release 10 further includes elongated release means 34 pivotally mounted at point 36 within body 16. Release means 34 is pivotable between a first position shown in FIG. 2 in which movement of sear 22 from its string retaining position is prevented and a second position shown in FIG. 3 in which movement of sear 22 to a string release position is allowed. A spring 38 is disposed within a cavity in body 16 and acts on a portion of release means 34 to urge it in a clockwise direction towards its first position.

Release 10 is provided with a trigger member 40 that operably engages a rear portion of release means 34 and extends rearwardly and outwardly through opening 42 in body 16 where it terminates in a thumb engaging portion 44.

A trigger tension adjustment means 64 is provided in the form of a spring 66 coaxially disposed about trigger 40 between a spring seat 68 in body 16 and an axially movable abutment 70 on a threaded portion of body 16. The position of abutment 70 is varied by rotation of tension dial 72. The amount of force needed to move trigger 40 can thus be varied by varying the compression of spring 66.

Body 16 is further provided with a threaded cavity 46 in which threaded release adjustment means 48 is disposed. End portion 50 of release adjustment means 48 engages a portion of release means 34 so that movement of adjustment means 48 will cause slight pivotal movement of release means 34 which in turn will adjust the amount of surface 52 on release means 34 that will engage sear 22. Adjustment 48 can thus be utilized to vary the amount of trigger travel needed before bow string 18 is released.

Bow release 10 is also provided with an automatic locking device in the form of finger 54 that extends downwardly and forwardly into notch 20 when sear 22 is in its release position. When the archer positions bow release 10 on the bow, string 18 will engage finger 54 and as string 18 is moved into notch 20 sear 22 will be rotated clockwise to its string retaining position (FIG. 2) and release means 34 will be urged behind sear 22 by spring 38 so as to hold sear 22 in its string retaining position.

FIG. 5 illustrates a bow string 18 disposed within notch 20 prior to the archer pulling the bow to a drawn position. FIG. 7 illustrates bow string 18 within notch 20 and release 10 pulled to a drawn position so that bow string 18 engages sear 22 and forms a curve around sear 22. With prior art devices such as shown at FIGS. 9 and 10, rotation of the prior art release 56 is prevented due to the planar surfaces 58 and 60 on the bow release body immediately adjacent sear 62. As shown in FIG. 8, convexly curved surfaces 24, **24*a*, 26 and 26*a* on body 16 allow rotational movement of bow release 10 about a horizontal axis. While the degree of rotational movement can be varied by varying the size of release 10 and notch 20**, it has been found that a maximum rotation of 30° is most easily accommodated and most desirable. The archer is thus given the option and benefit of some rotational movement in his hand when in the drawn position without corners of the release body engaging the bow string.

Various modes of carrying out the invention are contemplated as being within the scope of the following claims particularly pointing out and distinctly claiming the subject matter which is regarded as the invention.

I claim:

1. A bow string release comprising:

a body having a string receiving notch therein, said notch defined by a plurality of body surfaces with said surfaces shaped such that when the bow string has been pulled to a drawn position the release may be rotated a predetermined amount about a substantially horizontal axis, said body surfaces comprising a first pair of surfaces disposed adjacent a portion of the bow string disposed above said sear when in the drawn position and a second pair of surfaces disposed adjacent a portion of the bow string disposed below said sear when in the drawn position, a sear pivotally mounted in said body adjacent said notch and movable between a retaining position in which the bow string is retained in said notch and a release position in which the bow string is allowed to leave said notch, biasing means mounted in said body and urging said sear to said release position, release means pivotally disposed within said body and movable between a first position in which movement of said sear from said retaining position to said release position is prevented and a second position in which movement of said sear is permitted, and trigger means connected to said release means and extending outwardly from said body through an opening provided in said body, said trigger means operative to move said release means from said first to said second position.

2. The bow string release defined in claim 1 further comprising biasing means disposed within said body and urging said release means to said first position.

3. The bow string release defined in claim 1 further comprising release adjustment means disposed within said body and engageable with said release means so that said release means first position may be varied by movement of said release adjustment means.

4. The bow string release defined in claim 1 further comprising trigger adjustment means operably connected to said trigger so that the amount of force needed to move said trigger may be varied by movement of said trigger adjustment means.

5. The bow string release defined in claim 1 further comprising a finger extending downwardly and forwardly into said notch from a rear portion of said sear when said sear is in said release position so that a bow string being moved into said notch will engage said finger moving it rearwardly in said notch and causing said sear to pivot to said retaining position.

6. The bow string release defined in claim 1 wherein said body lies in a horizontal plane and said convexly rounded surfaces permit a maximum of substantially 30° of rotation out of said horizontal plane.

7. A bow string release comprising:

a body having a plurality of surfaces defining a string receiving notch, string retaining means mounted in said body adjacent said notch and movable between a retaining position in which the bow string is retained in said notch and a release position in which the bow string is allowed to leave said notch, and said surfaces being convexly rounded so that when the bow string has been pulled to a drawn position the release may be rotated a predetermined amount about a substantially horizontal axis wherein a first pair of surfaces is disposed adjacent a portion of the bow string disposed above said string retaining means when in the drawn position and a second pair of surfaces is disposed adjacent a portion of the bow string disposed below said string retaining means when in the drawn position.

8. The bow string release defined in claim 7 wherein said body lies in a horizontal plane and said convexly rounded surfaces permit a maximum of substantially 30° of rotation out of said horizontal plane.

9. The bow string release defined in claim 7 further comprising biasing means mounted in said body and urging said string retaining means to said release position.

10. The bow string release defined in claim 7 further comprising release means pivotally disposed within said body and movable between a first position in which movement of said string retaining means from said retaining position to said release position is prevented and a second position in which movement of said string retaining means is permitted.

11. The bow string release defined in claim 10 further comprising trigger means connected to said release means and extending outwardly from said body through an opening provided in said body, said trigger means operative to move said release means from said first to said second position.

12. The bow string release defined in claim 11 further comprising biasing means disposed within said body and urging said release means to said first position.

13. The bow string release defined in claim 11 further comprising release adjustment means disposed within said body and engageable with said release means so that said release means first position may be varied by movement of said release adjustment means.

14. The bow string release defined in claim 11 further comprising trigger adjustment means operably connected to said trigger so that the amount of force needed to move said trigger may be varied by movement of said trigger adjustment means.

15. The bow string release defined in claim 7 further comprising a finger extending downwardly and forwardly into said notch from a rear portion of said sear when said sear is in said release position so that a bow string being moved into said notch will engage said finger moving it rearwardly in said notch and causing said sear to pivot to said retaining position.

* * * * *